US008454799B2

(12) United States Patent
Jehn-Rendu et al.

(10) Patent No.: US 8,454,799 B2
(45) Date of Patent: Jun. 4, 2013

(54) PULP COMPOSITION FOR PAPER AND SOLID BOARD PRODUCTION

(75) Inventors: Christian Jehn-Rendu, Shanghai (CN); Hans-Georg Lemaire, Limburgerhof (DE); Oliver Koch, Wachenheim (DE); Tilo Habicher, Speyer (DE); Sylke Haremza, Neckargemuend (DE); Markus Hoffmann, Barcelona (ES)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/100,522

(22) Filed: May 4, 2011

(65) Prior Publication Data

US 2011/0290434 A1 Dec. 1, 2011

Related U.S. Application Data

(60) Provisional application No. 61/331,420, filed on May 5, 2010.

(51) Int. Cl.
*D21F 11/00* (2006.01)

(52) U.S. Cl.
USPC ..... 162/202; 162/4

(58) Field of Classification Search
USPC ..... 162/4, 202
See application file for complete search history.

(56) References Cited

U.S. PATENT DOCUMENTS

| | | | | |
|---|---|---|---|---|
| 6,228,126 | B1 | 5/2001 | Cimecioglu et al. | |
| 6,379,494 | B1 | 4/2002 | Jewell et al. | |
| 2002/0098317 | A1 * | 7/2002 | Jaschinski et al. | 428/72 |
| 2005/0028956 | A1 | 2/2005 | Winslow | |

FOREIGN PATENT DOCUMENTS

| | | | |
|---|---|---|---|
| EP | 1 077 286 | A1 | 2/2001 |
| EP | 1 106 732 | A2 | 6/2001 |
| EP | 1 505 208 | A2 | 2/2005 |
| WO | WO 99/23117 | | 5/1999 |
| WO | WO 00/68500 | | 11/2000 |
| WO | WO 01/29309 | A1 | 4/2001 |
| WO | WO 2010/020551 | A1 | 2/2010 |
| WO | WO 2010/026101 | A1 | 3/2010 |
| WO | WO 2010/145956 | A1 | 12/2010 |

OTHER PUBLICATIONS

Elais Retulainen, "Properties of Mechanical and chemical pulp blends" 1991, International Paper Physics conference presetned at Tappi.org.*

U.S. Appl. No. 13/058,217, filed Feb. 9, 2011, Hans-Joachim Haehnle, et al.

U.S. Appl. No. 13/058,874, filed Apr. 1, 2011, Torsten Klein, et al.

U.S. Appl. No. 13/376,509, filed Dec. 6, 2011, Jehn-Rendu, et al.

* cited by examiner

*Primary Examiner* — Jacob Thomas Minskey

(74) *Attorney, Agent, or Firm* — Oblon, Spivak, McClelland, Maier & Neustadt, L.L.P.

(57) ABSTRACT

The present invention relates to a novel pulp composition for paper or solid board production comprising an oxidized recovered paper pulp and/or an oxidized mechanical pulp into which from 1 to 500 mmol of carboxyl groups per kg and from 1 to 200 mmol of aldehyde groups per kg have been introduced by oxidation. The invention also relates to paper and solid board based on such a pulp composition and also to a process for producing such paper or solid board. The invention also relates to the use of oxidized recovered paper pulp and/or oxidized mechanical pulp for improving the retention and drainage properties of a pulp suitable for producing paper or solid board. The invention further relates to the use of oxidized recovered paper pulp and/or oxidized mechanical pulp for improving, i.e., increasing, the dry strength of paper and solid board.

9 Claims, No Drawings

PULP COMPOSITION FOR PAPER AND SOLID BOARD PRODUCTION

CROSS-REFERENCE TO RELATED APPLICATIONS

This application claims the benefit of priority under 119(e) of U.S. Provisional Application No. 61/331,420, filed May 5, 2010.

The present invention relates to a novel pulp composition for paper or solid board production, said novel pulp composition comprising an oxidized recovered paper pulp and/or an oxidized mechanical pulp. The invention also relates to paper and solid board based on such a pulp composition and also to a process for producing such paper or solid board. The invention also relates to the use of oxidized recovered paper pulp and/or oxidized mechanical pulp for improving the retention and drainage properties of a stock suitable for the production of paper or solid board. The invention further relates to the use of oxidized recovered paper pulp and/or oxidized mechanical pulp for improving, i.e., increasing, the dry strength of paper and solid board.

BACKGROUND OF THE INVENTION

Many papers are currently produced using recovered paper pulp, i.e., a paper stock obtained by recycling wastepaper, or using mechanical pulp. Since the cost of recovered paper pulp and of mechanical pulp is significantly lower than that of virgin paper stock, increasing the proportion of recovered paper pulp or of mechanical pulp in the fiber or paper stock used for paper or solid board production represents a huge economic benefit to the paper manufacturer. However, the quality of the recovered paper pulp frequently leaves something to be desired when in the course of recycling paper and solid board or in the course of the mechanical destructurization of wood the structure of the fibers is damaged, which leads to lower strength values in the paper. Accordingly, the amount of recovered paper pulp or of mechanical pulp in the paper stock used for producing paper and solid board is limited. Increasing the proportion of recovered paper pulp and/or mechanical pulp, however, is desirable for the abovementioned reasons.

There have been various reports of producing paper by using a paper stock in which the cellulose fibers have been subjected to an oxidation beforehand.

WO 99/23117 describes a method of oxidizing cellulose fibers in paper stocks wherein a paper stock is oxidized with an oxidizing enzyme, for example a laccase, in the presence of a mediator. The pulps proposed are mechanical, chemical, chemomechanical and recycled pulps. The method is said to lead to improved flexibility, an improved water retention value (WRV) and increased strength.

EP 1077286 describes the use of an aldehyde-modified cellulose pulp for producing paper. Aldehyde groups are introduced into the cellulose pulp via chemical oxidation, for example with sodium hypochlorite in the presence of a mediator. The cellulose pulp thus modified leads more particularly to improved wet tensile strength and an increase in the ratio of wet tensile strength to dry tensile strength. A similar state of affairs is known from EP 1106732, although here a hydroxyl-containing polymer is used in addition.

WO 00/68500 likewise describes a process for producing paper having improved wet strength properties wherein an unbleached or semi-bleached chemical or semichemical pulp or pulp from recycled fibers treated with a phenol-oxidizing enzyme, for example a laccase, in the presence of a mediator, for example TEMPO (2,2,6,6-tetramethyl-piperidinyloxyl), was used.

WO 01/29309 likewise describes a process for producing paper utilizing a paper stock whose cellulose fibers have beforehand been treated with an oxidizing agent in the presence of a mediator. Again, the oxidation leads to an improvement in the wet strength properties of the paper.

Although the use of oxidized pulps is described in the prior art cited here, such oxidized pulps have hitherto not been used in the paper industry. One reason for this may be that the oxidation damages the cellulose fibers structurally, which leads to a worsening in the dry strength properties of the paper, more particularly the (tongue) tear energy. By contrast, the observed improvement in wet tensile strength compared with untreated fibers is substantial, for example up to ten times compared with untreated fibers. However, this is not desirable in many cases, since this distinctly increases the energy requirements for reprocessing the paper.

A further problem in the production of paper or solid board is the often unsatisfactory retention property of the pulp compositions used for paper or solid board production, more particularly of those kinds of pulp compositions which include a high proportion of recovered paper and/or mechanical or thermomechanical pulp, requiring larger amounts of retention aids to be used. Often, the drainage properties of the pulp compositions are also unsatisfactory.

It is an object of the present invention to provide pulp compositions for paper or solid board production which ameliorate the disadvantages of the prior art.

BRIEF SUMMARY OF THE INVENTION

We have found that this object is achieved by the pulp composition of the present invention in that, surprisingly, an oxidized pulp in which, by oxidation of at least one conventional pulp selected from the group consisting of recovered paper pulp, mechanical pulp and mixtures thereof, from 1 to 500 mmol of carboxyl groups and from 1 to 200 mmol of aldehyde groups per kg of conventional pulp have been introduced, reckoned oven dry, improves the retention properties of pulp compositions and of aqueous fiber suspensions for paper production by effecting, for example, an increase in first pass retention (FPR) and/or an increase in ash retention as can be determined using for example the Britt Jar Test Method of TAPPI T-261. This holds more particularly in the case of paper and solid board produced from a pulp composition which, in addition to the oxidized pulp as constituent B, further comprises chemical pulp as constituent A and at least one further conventional pulp C other than the chemical pulp of constituent A and the oxidized pulp B, wherein the total amount of oxidized pulp and chemical pulp in the pulp composition accounts for from 30% to 80% by weight of the entire pulp mass in the pulp composition and the constituents A, B and C account for at least 70%, more particularly at least 80% and specifically at least 90% or 100% of the entire pulp mass in the pulp composition, wherein the recited amounts of the constituents A, B and C are each reckoned as oven dry material. In addition, the use of such an oxidized pulp B leads to an improvement in the dry strength properties of paper or solid board without incurring a significant increase in the wet strength properties. It additionally emerges that the use of such oxidized pulps is able to improve the drainage properties of the aqueous fiber suspension, i.e., shortens the paper production drainage time as can be determined for example in accordance with ISO Standard 5267.

The present invention accordingly provides for the use of an oxidized pulp B into which, by oxidation of at least one conventional pulp selected from the group consisting of recovered paper pulp, mechanical pulp and mixtures thereof, from 1 to 500 mmol, more particularly from 5 to 200 mmol and specifically from 10 to 150 mmol of carboxyl groups per kg of conventional pulp and from 1 to 200 mmol, more particularly from 2 to 150 mmol and specifically from 5 to 100 mmol of aldehyde groups per kg of conventional pulp have been introduced, for improving the retention properties or for improving the drainage properties of the here and hereinbelow defined pulp compositions, and/or for improving the dry strength properties, more particularly the dry tensile strength, the tongue tear strength and the bursting pressure of paper or solid board, more particularly of paper or solid board produced using the here and hereinbelow defined pulp compositions.

The present invention further relates to the use of an oxidized pulp B into which, by oxidation of at least one conventional pulp selected from the group consisting of recovered paper pulp, mechanical pulp and mixtures thereof, from 1 to 500 mmol, more particularly from 5 to 200 mmol and specifically from 10 to 150 mmol of carboxyl groups per kg of conventional pulp and from 1 to 200 mmol, more particularly from 2 to 150 mmol and specifically from 5 to 100 mmol of aldehyde groups per kg of conventional pulp have been introduced, for improving the retention properties of aqueous fiber suspensions, more particularly of such fiber suspensions as comprise the here and hereinbelow recited pulp composition as fiber constituents.

The present invention accordingly provides for the use of an oxidized pulp B into which, by oxidation of at least one conventional pulp selected from the group consisting of recovered paper pulp, mechanical pulp and mixtures thereof, from 1 to 500 mmol, more particularly from 5 to 200 mmol and specifically from 10 to 150 mmol of carboxyl groups per kg of conventional pulp and from 1 to 200 mmol, more particularly from 2 to 150 mmol and specifically from 5 to 100 mmol of aldehyde groups per kg of conventional pulp have been introduced, for improving the drainage properties of aqueous fiber suspensions, more particularly such fiber suspensions as comprise here and hereinbelow recited pulp composition as fiber constituents.

The present invention further provides a pulp composition for paper or solid board production, comprising a) at least one chemical pulp A, and b) at least one oxidized pulp B in which, by oxidation of at least one conventional pulp selected from the group consisting of recovered paper pulp, mechanical pulp and mixtures thereof, from 1 to 500 mmol, more particularly from 5 to 200 mmol and specifically from 10 to 150 mmol of carboxyl groups per kg of conventional pulp and from 1 to 200 mmol, more particularly from 2 to 150 mmol and specifically from 5 to 100 mmol of aldehyde groups per kg of conventional pulp have been introduced, and c) at least one further conventional pulp C other than A and B;

wherein the total amount of the constituents A and B accounts for from 30% to 80% by weight of the entire pulp mass in the pulp composition, and the constituents A, B and C account for at least 70%, more particularly at least 80% and specifically at least 90% or 100% of the entire pulp mass in the pulp composition, where the recited amounts of constituents A, B and C are each reckoned as oven dry material.

The present invention further provides a paper stock comprising as fiber constituents a pulp composition as herein described, and also papers or solid board based on such a pulp composition.

The use of an oxidized pulp B as herein described makes it possible—for the same dry strength properties—to increase the proportion of recovered paper pulp and/or mechanical pulp in the pulp composition used for paper or solid board production at the expense of the more costly chemical pulp. In other words, a paper or solid board produced using a pulp composition of the present invention displays for the same proportion of chemical pulp and the same proportion of recovered paper and/or mechanical pulp (oxidized pulp B plus any conventional recovered paper pulp and/or mechanical pulp present) superior dry strength properties to a paper or solid board produced using a pulp composition which, in addition to chemical pulp, only comprises conventional recovered paper pulp and/or mechanical pulp. This makes it possible to increase the total amount of recovered paper pulp and/or mechanical pulp (oxidized pulp B plus any conventional recovered paper pulp and/or mechanical pulp present) by at least 50%, more particularly at least 90% in the pulp composition without having to accept reductions in the dry strength properties. It additionally emerges that the wet strength properties are only increased insignificantly, if at all, i.e., to an extent which has no appreciable effect on later repulping, and this is advantageous with regard to any recycling of a paper or solid board produced from this pulp composition. The better retention properties also make it possible to increase the proportion of filler in the fiber suspensions, based on the total amount of stock.

DETAILED DESCRIPTION OF THE INVENTION

According to the present invention, the pulp composition comprises as constituent A a chemical pulp obtained by chemical destructurization of a lignocellulose material such as wood. Examples of chemical pulps include sulfate pulp, sulfite pulp and/or soda pulps. Chemical pulp may be bleached or unbleached. Bleached chemical pulps include chlorine-bleached or more particularly elemental chlorine-free or totally chlorine-free pulps, such as ECF pulp and TCF pulp. Unbleached chemical pulp is preferred. Also suitable is chemical pulp from annual plants, for example chemical pulp based on rice, wheat, sugar cane (bagasse), bamboo or kenaf.

Chemical pulp is typically used in small amounts only. Just a few % by weight of constituent A, based on total pulp mass in the pulp composition, will generally be sufficient to achieve the desired strengths. The proportion of chemical pulp in the pulp composition will typically be in the range from 1% to 50% by weight, frequently in the range from 2% to 30% by weight and more particularly in the range from 5% to 20% by weight, based on total pulp mass in the pulp composition.

The amount of oxidized pulps B, viz., oxidized recovered paper pulp and/or oxidized mechanical pulp, is typically in the range from 10% to 79%, frequently in the range from 20% to 68% and more particularly in the range from 30% to 55% by weight, based on total pulp mass in the pulp composition.

The amount of chemical pulps A and oxidized pulps B according to the present invention is in the range from 20% to 80% by weight, frequently in the range from 30% to 70% by weight and more particularly in the range from 40% to 60% by weight, based on total pulp mass in the pulp composition.

In addition to the aforementioned pulps of components A and B, the pulp composition of the present invention comprises as constituent C at least one further conventional pulp other than pulps A and B. These pulps include more particularly conventional recovered paper and conventional woodpulp, for example groundwood (=mechanical pulp), e.g., white or brown mechanical pulp, thermomechanical pulp (TMP), chemothermomechanical pulp (CTMP), semichemical pulp, high yield chemical pulp and refiner mechanical pulp (RMP). Constituent C preferably comprises mechanical pulp, i.e., groundwood, thermomechanical pulp (TMP) and refiner mechanical pulp (RMP) as well as recovered paper in particular. Particular preference is given to recovered paper pulp and mechanical pulp and mixtures thereof. It is very particularly preferred for constituent C to be recovered paper pulp (recycling fibers) and fiber mixtures consisting of recovered paper pulp to an extent of at least 30% by weight, more particularly at least 50% by weight, based on the total mass of constituents C, preferably in admixture with mechanical pulp.

The conventional recovered paper pulp can be any paper stock recovered from any species of used, printed or unprinted paper, more particularly recovered paper as defined in the EN 643 list of standard grades of recovered paper and board, for example DIP sorted graphic paper for deinking (1.11), old newsprint (ONP), mixed office waste (MOW), sorted office waste (SOW), (old) journals/magazines (HOMP), colored letters (2.06 in EN 643), old corrugated containers (OCC) and/or mixed papers and boards, including for example mixed bails (1.02), supermarket corrugated paper and board (1.04), corrugated kraft II (4.03), multi printing (3.10), white newsprint (3.14/3.15) and white woodfree uncoated shavings (3.18.01). The number between parentheses refers in each case to the number assigned under EN 643. Corresponding wastes or packaging from solid board or paperboard, including composites of paper, solid board or paperboard with other materials, such as polymeric coatings or linings, may also be concerned. The essential aspect of the recovered paper pulp used according to the present invention is that, unlike virgin fiber material, which has not as yet been subjected to any destructurization and/or has not as yet been processed into paper or paperboard products, recovered paper material is concerned. Secondary fibers are also mentioned in this connection. Recovered paper raw material also includes coated broke which comprises binder from the coating slip as well as fiber constituents.

In the pulp compositions of the present invention, the constituents B and C account for generally from 50% to 99% by weight, frequently from 60% to 98% by weight, more particularly from 70% to 98% by weight, more particularly from 70% to 95% by weight and specifically from 80% to 95% by weight, based on the total pulp mass in the pulp composition.

In the pulp compositions of the present invention, the total amount of the constituents A, B and C is at least 70% by weight, frequently at least 80% by weight, more particularly at least 90% by weight and specifically at least 99% or 100% by weight, based on the total pulp mass in the pulp composition. In addition, the pulp composition may further comprise up to 30% by weight but frequently not more than 20% or 10% by weight of or essentially no (<1% by weight) further fiber constituents.

Here and hereinbelow, the term "total pulp mass" refers to the dry mass of the fiber constituents (oven dry, water content <1%) in the pulp composition.

By way of constituent B, the pulp composition comprises at least one oxidized pulp selected from oxidized recovered paper pulp, oxidized mechanical pulp and mixtures thereof. Mechanical pulp here is to be understood as referring to groundwood such as white or brown mechanical pulp. So the oxidized pulp comprises a fiber material based on the aforementioned pulps, into which from 1 to 500 mmol, more particularly from 5 to 200 mmol and specifically from 10 to 150 mmol of carboxyl groups per kg of conventional pulp and from 0 to 200 mmol, more particularly from 2 to 150 mmol and specifically from 5 to 100 mmol of aldehyde groups per kg of conventional pulp have been introduced by an oxidation process. These amount recitations relate to the amount of carboxyl groups and aldehyde groups introduced by the oxidation process and not to the total amount of carboxyl and aldehyde groups present in the recovered paper pulp and/or mechanical pulp, which his generally higher, since conventional recovered paper raw material or mechanical pulp generally already comprises aldehyde and/or carboxyl groups.

Preference is given to oxidized recovered paper pulp and also to mixtures of oxidized recovered paper pulp with oxidized mechanical pulp wherein the proportion of oxidized recovered paper pulp is at least 30% by weight and more particularly at least 50% by weight, based on the total mass of the constituents B.

The amount of aldehyde and carboxyl groups introduced into the pulp by oxidation can be determined by a person skilled in the art in a conventional manner by determining the absolute level of aldehyde and/or carboxyl groups before and after oxidation. Absolute determination of the aldehyde and carboxyl groups is accomplished by customary methods of titration as described in the prior art, for example in EP 1077286 or EP 1106732. Aldehyde groups are typically determined by derivatizing the aldehyde with hydroxylammonium chloride and titrating the hydrogen chloride released in the process with aqueous sodium hydroxide solution. The level of carboxyl groups is typically determined by titration with aqueous sodium hydroxide solution.

It is believed that oxidation of the conventional pulp generates additional aldehyde and carboxyl groups on the surfaces of the cellulose fibers in the recovered paper pulp, i.e., in the cellulose and hemicellulose constituents of these fibers, for example by oxidation of the $C_6$—OH group in the glucose units of the cellulose and hemicellulose constituents of the cellulose fibers. It is further believed that the laccase preferably used for oxidizing the cellulose materials leads to changes in the lignin content of the cellulose materials. It is believed that these modifications of the cellulose constituents in the recovered paper pulp or mechanical or thermomechanical pulp combined with the virgin fiber in the pulp composition lead to an improvement in the retention and drainage properties of the pulp composition and also to an improvement in the dry strength properties of the paper or solid board produced from the pulp composition.

It will further be advantageous for the molar ratio of the carboxyl groups introduced by oxidation to the aldehyde groups introduced by oxidation to be not less than 0.8:1, preferably not less than 1:1 and more particularly not less than 1.2:1. This molar ratio is preferably in the range from 0.8:1 to 10:1, more particularly in the range from 1:1 to 8:1 and specifically in the range from 1.2:1 to 5:1.

The oxidation of the conventional pulp can be carried out in a conventional manner. The amount of aldehyde groups and carboxyl groups introduced by oxidation can be controlled by a person skilled in the art by choosing suitable reaction conditions and reagent quantities, for which he or she can determine the necessary reaction conditions and reagent quantities through routine experimentation.

Conventional mechanical pulp can be groundwood such as white or brown mechanical pulp, which can be bleached or unbleached.

The conventional recovered paper pulp for the oxidation can be any paper stock recovered from any species of used, printed or unprinted paper, more particularly recovered paper as defined in the EN 643 list of standard grades of recovered paper and board, for example DIP sorted graphic paper for deinking (1.11), old newsprint (ONP), mixed office waste (MOW), sorted office waste (SOW), (old) journals/magazines (HOMP), colored letters (2.06 in EN 643), old corrugated containers (OCC) and/or mixed papers and boards, including for example mixed bails (1.02), supermarket corrugated paper and board (1.04), corrugated kraft II (4.03), multi printing (3.10), white newsprint (3.14/3.15) and white woodfree uncoated shavings (3.18.01). The number between parentheses refers in each case to the number assigned under EN 643. Corresponding wastes or packaging from solid board or paperboard, including composites of paper, solid board or paperboard with other materials, such as polymeric coatings or linings, may also be concerned. The essential aspect of the recovered paper pulp used according to the present invention is that, unlike virgin fiber material, which has not as yet been subjected to any destructurization and/or has not as yet been processed into paper or paperboard products, recovered paper material is concerned. Secondary fibers are also mentioned in this connection. Recovered paper raw material also includes coated broke which comprises binder from the coating slip as well as fiber constituents.

Enzymatic methods of oxidation can be used as well as conventional chemical methods for oxidation. It will be advantageous for the quality of the oxidized pulp for the oxidation to be carried out enzymatically. This is believed because this minimizes damaging the cellulose fibers through oxidative cleavage.

For enzymatic oxidation, the conventional recovered paper pulp is treated with atmospheric oxygen in the presence of an oxidase or with hydrogen peroxide in the presence of a suitable peroxidase. Preference is given to oxidases such as catecholoxidase (EC 1.10.3.1), laccases (EC 1.10.3.2), bilirubin oxidases (EC 1.3.3.5). Preferably, the oxidizing enzyme comprises a laccase. Any laccase is suitable in principle. For example, the laccase may be derived from the strains *Polyporus* sp., more particularly *Polyporus pinsitus* (also known as *Trametes villosa*), *Polyporus versicolor* (=*Trametes versicolor*), *Myceliophthora* sp., for example *M. thermophila*, *Rhizoctonia* sp., more particularly *Rhizoctonia praticola* or *Rhizoctonia solani*, from *Scytalidium* sp., more particularly *S. thermophilium*, from *Pyricularia* sp., more particularly *Pyricularia oryzae* or *Coprinus* sp. such as *C. cinereus*. The laccases may also be derived from fungi such as *Collybia, Fomes, Lentinus, Pleurotus, Aspergillus, Neurospora, Podospora, Phlebia*, for example *P. radiata* (see WO 92/01046), *Coriolus* sp., for example *C. hirsitus* (JP 2-238885), or *Botrytis*. Suitable laccases are known to a person skilled in the art and are also commercially available.

The amount of laccase is generally chosen such that its activity is in the range from 0.1 to 14 000 U, more particularly in the range from 0.5 to 1 000 U and more preferably in the range from 1 to 400 U, all based on 1 g of oven dry conventional pulp.

Enzyme activity can be determined in a conventional manner by means of the substrate syringaldazine (4,4'-(azinobis(methanylylidene))bis(2,6-dimethoxyphenol)). The rate of oxidation of syringaldazine to the corresponding quinone (4,4'-azobis(methanylyliden))bis(2,6-dimethoxycyclohexa-2,5-dien-1-one) by measuring the absorption at 530 nm. 1 unit (U) corresponds to the conversion of 1 μMol of syringaldazine per minute.

To oxidize the recovered paper or mechanical pulp, it is generally converted into an aqueous suspension and admixed with the enzyme. The amount of oxygen required for oxidation is introduced by agitating the suspension or by passing oxygen into it. When peroxidases are used to perform the oxidation, it will be appreciated that hydrogen peroxide is added as an oxidizing agent.

The water used for producing the aqueous suspension of the recovered paper or mechanical pulp can be process water as well as fresh water. Pulp consistency in the aqueous suspension is typically in the range from 1 to 100 g/l, more particularly in the range from 5 to 80 g/l and specifically in the range from 10 to 50 g/l (all based on oven dry recovered paper or mechanical pulp).

The pH of the aqueous suspension depends in a well-known manner on the best pH for the particular enzyme, and can be set by addition of acids or alkalis or buffers, more particularly by addition of aqueous sodium hydroxide solution, aqueous potassium hydroxide solution or a buffer, such as potassium dihydrogenphosphate buffer, and, optionally, be policed in the course of the oxidation by addition of a base. The pH of the aqueous recovered paper pulp suspension is typically in the range from 3 to 10 and more particularly in the range from 4 to 9.

The temperature at which the oxidation is carried out depends, as will be appreciated, on the oxidizing agent used. In the case of an enzymatic oxidation, the temperature preferably depends on the best temperature for the activity of the particular enzyme chosen. This temperature is typically in the range from 20 to 40° C.

Oxidation time depends in a well-known manner on the identity and amount of the particular oxidizing agent chosen and on the other reaction conditions such as temperature and pH and in the case of an enzymatic oxidation on the activity and amount of the enzyme under the particular reaction conditions. The best reaction conditions for the oxidation can be determined by a person skilled in the art in the course of routine tests. Oxidation time is typically in the range from 5 minutes to 24 hours, more particularly in the range from 10 minutes to 18 hours and more preferably in the range from 20 minutes to 12 hours.

In a preferred embodiment of the invention, the conventional pulp is oxidized in the presence of at least one mediator compound, hereinafter also referred to as a redox mediator. A redox mediator ensures that the oxidizing agent does not react directly with the OH groups in the glucose units of the cellulose and hemicellulose constituents, or with the lignin constituents, but first oxidizes the mediator which in turn effects an oxidation of the (hemi)cellulose fibers or lignin present in the conventional pulp. Using a mediator is advantageous in the case of an enzymatic oxidation in particular.

Examples of suitable mediator compounds are in principle any of the compounds described for this purpose in the prior art, for example the compounds described in WO 00/68500 pages 8 and 9, for example benzothiazoline compounds, such as 2,2'-azinobis(3-ethylbenzothiazoline-6-sulfonate) (ABTS), 2-(p-aminophenyl)-6-methylbenzothiazole-7-sulfonic acid and 3-methyl-2-benzothiazolinone;

naphthalene compounds, for example 6-hydroxy-2-naphthalenecarboxylic acid, 7-methoxy-2-naphthol, 7-amino-2-naphthalenesulfonic acid, 5-amino-2-naphthalene-sulfonic acid, 1,5-diaminonaphthalene and 7-hydroxy-1,2-naphthimidazole;

Phenothiazine compounds, such as 10-methylphenothiazine, 10-phenothiazine-propionic acid (PPT), N-hydroxysuccinimide-10-phenothiazinepropionate, 10-ethyl-4-phenothiazinecarboacid, 10-ethylphenothiazine, 10-propylphenothiazine, 10-isopropylphenothiazine, methyl phenothiazin-1-ylpropionate, 10-phenylphenothiazine, 10-allylphenothiazine, 10-(3-(4-methyl-1-piperazinyl)-propyl)phenothiazine, 10-(2-pyrrolidinoethyl)phenothiazine, 10-(2-hydroxyethyl)-phenothiazine, 2-acetyl-10-methylphenothiazine or 10-(3-hydroxypropyl)phenothiazine; benzidine compounds, for example benzidine or 3,3'-dimethoxybenzidine;

stilbene compounds, such as 4-amino-4'-methoxystilbene, 4,4'-diaminostilbene-2,2'-disulfonic acid or iminostilbene;

phenoxazine compounds, such as 10-phenoxazinepropionic acid (POP), 10-methyl-phenoxazine or 10-(2-hydroxyethyl) phenoxazine;

N-(4-(dimethylamino)benzylidene)-p-anisidine;

triphenylamine;

biphenylamines, such as N-benzylidene-4-biphenylamine or 4,4'-dimethoxy-N-methyl-diphenylamine;

the phenol compounds described in WO 96/10079, such as acetosyringone, syringaldehyde, methyl syringate, syringic acid, ethyl syringate, propyl syringate, butyl syringate, hexyl syringate, octyl syringate, vanillic acid, NAH, HOBT, PPO and violoric acid;

further the compounds described in WO 95/01426 pages 9 to 11 and also more particularly sterically hindered nitroxyl compounds or nitroxyl free radicals, such as TEMPO (2,2,6,6-tetramethylpiperidinyl-1-oxy), and derivatives of TEMPO, such as acetamido-TEMPO, BI-TEMPO, 4-hydroxy-TEMPO, 4-methoxy-TEMPO, 4-benzyloxy-TEMPO, 4-amino-TEMPO, 4-acetylamino-TEMPO, 4-ethylcarbonylamino-TEMPO, 4-propylcarbonylamino-TEMPO, 4-isopropylcarbonylamino-TEMPO, 4-1-methylethylcarbonylamino-TEMPO, methyl 2,2,6,6-tetramethylpiperidin-1-oxy-4-y-oxalate, 2,2-dimethyl-4-oxa-1-aza-1-oxyspiro[5.5]undecane, 4-acetoxy-TEMPO, 7,7-dimethyl-9-oxa-6-aza-6-oxy-spiro[4.5]decane, 7,7,9,9-tetramethyl-1,4-dioxa-8-aza-8-oxy-spiro[4.5]decane, 1-ethyl-3-(2,2,6,6-tetramethylpiperidin-1-oxy-4-yl)urea, 1-isopropyl-3-(2,2,6,6-tetramethylpiperidin-1-oxy-4-yl)urea, 1-propyl-3-(2,2,6,6-tetramethylpiperidin-1-oxy-4-yl)urea, 1-butyl-3-(2,2,6,6-tetramethylpiperidin-1-oxy-4-yl)urea, 1-isobutyl-3-(2,2,6,6-tetramethylpiperidin-1-oxy-4-yl)urea, 1-phenyl-3-(2,2,6,6-tetramethylpiperidin-1-oxy-4-yl)urea, 1,1-diethyl-3-(2,2,6,6-tetramethylpiperidin-1-oxy-4-yl)urea, 1-ethyl-3-(2,2,6,6-tetramethylpiperidin-1-oxy-4-yl)thiourea, 1,1-diisopropyl-3-(2,2,6,6-tetramethylpiperidin-1-oxy-4-yl)urea, ethyl (2,2,6,6-tetramethylpiperidin-4-yl-4-oxy-)carbamate, propyl (2,2,6,6-tetramethylpiperidin-4-yl-4-oxy)carbamate, isopropyl (2,2,6,6-tetramethylpiperidin-4-yl-4-oxy)carbamate, butyl (2,2,6,6-tetramethylpiperidin-4-yl-4-oxy)carbamate, isobutyl (2,2,6,6-tetramethylpiperidin-4-yl-4-oxy)carbamate, 7,7,9,9-tetramethyl-2-propyl-1,3,8-triaza-1-oxyspiro[4.5.]decan-4-one, 7,7,9,9-tetramethyl-2-isopropyl-1,3,8-triaza-1-oxyspiro[4.5.]decan-4-one, 7,7,9,9-tetramethyl-2-ethyl-1,3,8-triaza-1-oxyspiro[4.5.]decan-4-one, 7,7,9,9-tetramethyl-2-butyl-1,3,8-triaza-1-oxyspiro[4.5.]decan-4-one, 4-acetylamino-2,2,6,6-tetramethylpiperidin-1-oxy-4-carboxylic acid, methyl 4-acetylamino-2,2,6,6-tetramethylpiperidin-1-oxy-4-carboxylate, ethyl 4-acetylamino-2,2,6,6-tetramethylpiperidin-1-oxy-4-carboxylate, isopropyl 4-acetylamino-2,2,6,6-tetramethylpiperidin-1-oxy-4-carboxylate, propyl 4-acetylamino-2,2,6,6-tetramethylpiperidin-1-oxy-4-carboxylate, further 3,3,5,5-tetramethylmorpholin-1-oxy (TEMMO), 3,4-dehydro-2,2,6,6-tetramethylpiperidinyl-1-oxy, cyclic acetals of 2,2,6,6-tetramethyl-4-piperidon-1-oxy, 2,2,5,5-tetramethylpyrrolidinyl-1-oxy and comparable structures. Sterically hindered nitroxyl compounds of this kind are preferred according to the present invention.

When a mediator is used, the amount of mediator is generally in the range from 1 mg to 100 g, preferably in the range from 10 mg to 50 g and more particularly in the range from 100 mg to 10 g, all based on 1 kg of oven dry fiber.

The oxidation is preferably carried out using a laccase, as described above, combined with a sterically hindered nitroxyl compound.

In another embodiment, the oxidation is carried out in the absence of a mediator compound.

For enzymatic oxidation using atmospheric oxygen, it is generally necessary to introduce atmospheric oxygen into the aqueous suspension of the pulp to be oxidized. This is generally accomplished by agitating the suspension, for example by stirring in suitable vessels, preferably vessels equipped with internals to improve commixing. If desired, atmospheric oxygen can also be blown into the reaction mixture.

The oxidized pulp B obtainable in this way can be used for producing a paper stock composition which is in accordance with the present invention.

In addition to the aforementioned components A, B and C, the pulp composition may comprise up to 10% by weight of further fiber constituents, based on the fiber mass in the composition, for example recycled coated broke.

To produce the pulp composition, the oxidized pulp B is mixed with the chemical pulp A and optionally further, conventional pulp C.

A possible general procedure for this is to mix the as-oxidized aqueous suspension of the oxidized pulp B with the pulp constituent A, preferably likewise in the form of an aqueous suspension, and optionally conventional pulp C, preferably likewise in the form of an aqueous suspension. It will be appreciated that it is also possible to suspend dry chemical pulp A and dry pulp C in an aqueous suspension of the oxidized pulp B.

It is likewise possible for the oxidized pulp B to be obtained in dry form and then to be suspended in water together with chemical pulp A and further pulp C and for the suspension thus obtained to be further processed. Preferably, however, the oxidized pulp B will not be converted into a dry form but will be mixed directly in the form of the as-oxidized aqueous suspension with the other constituents of the pulp composition.

The present invention further provides a process for producing a paper or solid board, comprising the steps of:

i) producing an aqueous fiber suspension comprising, as fiber constituents:

a) at least one chemical pulp A, and b) at least one oxidized pulp B, as herein described, and c) at least one further conventional pulp C other than A and B as herein described;

comprising suspending the pulps in water and optionally adding customary additives and fillers, and ii) draining the fiber suspension in a paper machine to form paper or solid board, wherein the relative amount of the pulps are chosen such that the total amount of the constituents A and B accounts for from 30% to 80% by weight of the entire pulp mass in the fiber suspension, and the total amount of the constituents A, B and C account for at least 70% of the entire pulp mass in the pulp composition, each reckoned as oven dry material. The relative amounts of the constituents A, B and C in the aqueous fiber suspension correspond to the relative amounts recited for the pulp composition, and are more particularly in the ranges recited there as preferred.

The oxidized pulp is provided in the manner described above. Step i) of the process then comprises producing an aqueous fiber suspension comprising the oxidized pulp, chemical pulp A and conventional pulp C, more particularly the pulps recited as preferred, in the amounts recited for the pulp composition. This aqueous suspension then has added to it customary additives and fillers, if needed for the particular paper grade.

Examples of customary additives are the customary papermaking additives for improving/modifying paper properties, such as fillers, sizing agents, wet and dry strength enhancers, antiblocking agents, flame retardants, antistats, hydrophobicizers, dyes and optical brighteners and also process chemicals, such as retention, flocculation and drainage aids, fixatives, mucilage control agents, wetters, defoamers, biocides and the like.

Examples of customary wet strength agents are the polyamides, epichlorohydrin resins, melamine-formaldehyde resins and cationic glyoxylated polyacrylamides typically used for this purpose.

Examples of customary dry strength agents are: native starches, starch derivatives, dextrans, cationized starch, cationically glyoxylated polyacrylamides, polyvinylamines, cationic, anionic or amphoteric polyacrylamides and also mixtures thereof with inorganic dry strength agents.

Examples of sizing agents (internal and surface sizing agents) are rosin sizers, casein and comparable proteins, starch, polymer dispersions, reactive sizers, more particularly alkylketene dimers and alkylsuccinic anhydrides.

In addition, the aqueous fiber suspension may also have added to it customary fillers insofar as they are not already introduced via the recovered paper materials. Examples of suitable fillers are more particularly calcium carbonate such as chalk, kaolin, titanium dioxide, gypsum, precipitated calcium carbonate, talc, silicates.

Examples of typical retention aids are aluminum sulfate and polyaluminum chlorites. Useful retention aids further include microparticulate systems of high molecular weight polyacrylamides and bentonite or colloidal silica. Useful retention aids further include combinations of microparticulate systems of high molecular weight polyacrylamides and bentonite or colloidal silica with anionic organic polymer, more particularly anionic, optionally crosslinked polyacrylamides. Retention aids based on microparticulate systems of this kind are known for example from EP 462365, WO 02/33171, WO 01/34908 or WO 01/34910. Useful retention aids also include partially hydrolyzed homopolymers of N-vinylformamide and also partially hydrolyzed copolymers of N-vinylformamide with diallyldimethylammonium chloride, N,N-dimethylaminoethylacrylamide, N,N-dimethylaminopropylacrylamide. Useful retention aids further include microparticulate systems of high molecular weight polyvinylamines and anionic, cationic or amphoteric crosslinked polyacrylamides known from US 2003/0192664 A1 for example.

Examples of customary flocculation and drainage aids are polyethyleneimines, polyamines having molar masses of more than 50 000, polyamidoamines optionally crosslinked by grafting with ethyleneimine and subsequent crosslinking with, for example, polyethylene glycol dichlorohydrin ethers, or with epichlorohydrin, polyether amines, polyvinylimidazoles, polyvinylimidazolines, polyvinyltetrahydropyridines, polydialkylaminoalkyl vinyl ethers, polydialkylaminoalkyl (meth)acrylates in protonated or quaternized form, polydiallyldialkylammonium halides, more particularly polydiallyldimethylammonium chloride.

Examples of customary fixatives are aluminum sulfate, polyaluminum chlorites, and also the cationic polymers customary for this purpose, examples being cationic polyacrylamides, polyethyleneimines, polyvinylamines, polyimidazolines, polyimidazoles, polyamines, dicyandiamide resins, poly-DADMAC, Mannich products and Hofmann products.

Process chemical and fillers depend, in terms of identity and amount, in a well-known manner on the requirements of the paper machine and of the desired paper variety.

The fiber suspension is subsequently drained in a paper machine to form paper or solid board. Optionally, the fiber suspension can be diluted with water before being introduced (as a thin pulp). Process chemicals can be added both prior to and after dilution.

The fiber material, which optionally further comprises fillers, is subsequently drained in a conventional manner to form a sheet. Draining is typically carried out in a paper machine in which the customary steps of paper formation are carried out, i.e., sheet formation on the wire, densification/pressing to remove the bulk of the water in the press end, drying in the dry end, glazing by calendering and optionally supercalendering. Optionally, the dry end may also comprise a size press in which the paper is treated with a thinly liquid size liquor for surface consolidation. Optionally, the paper machine may also comprise a coating range in which the paper is coated with a coating slip. An overview of customary processes for paper production is found in Roempp, Lexikon Chemie, 10th edition, Thieme Verlag Stuttgart, 1998, pages 3110 to 3115, and also in Ullmann's Encyclopedia of Industrial Chemistry, 5th Edition on CD-ROM (R-PAT, Paper and Pulp, Wiley-VCH 1997).

The pulp composition of the present invention and also the paper production process of the present invention are in principle suitable for producing all paper varieties that typically comprise recovered paper constituents, more particularly writing papers, i.e., filler-containing and fully sized papers having glazed surfaces, which typically have a basis weight in the range from 30 to 80 g/m$^2$ and a filler content in the range from 5% to 30% by weight and the surfaces of which are generally coated and which comprise a proportion of recovered paper fibers (total amount of oxidized and nonoxidized recovered paper fibers) in the range from 10% to 99% by weight, based on the total amount of the fiber constituents;

printing papers, i.e., papers which are coated or uncoated and suitable for printing, which typically have a basis weight in the range from 40 to 150 g/m$^2$, and can have a filler content of up to 20% by weight, which typically include a recovered paper fraction in the range from 10% to 99% by weight (total amount of oxidized and nonoxidized recovered paper fibers, based on total fiber quantity);

newsprint papers which typically have a basis weight in the range from 38 to 50 g/m$^2$ and can have a filler content in the range of up to 18% by weight, which typically include a recovered paper fraction in the range from 10% to 99% by weight (total amount of oxidized and nonoxidized recovered paper fibers, based on the total fiber quantity);

wrapping papers which typically have a basis weight in the range from 70 to 250 g/m$^2$ and can have a filler content of up to 15% by weight, which typically include a recovered paper fraction in the range from 10% to 99% by weight (total amount of oxidized and nonoxidized recovered paper fibers, based on the total fiber quantity);

solid board, which typically has a basis weight in the range from 250 to 1000 g/m$^2$ and can have a filler content of up to 15% by weight, which typically include a recovered paper fraction in the range from 10% to 99% by weight (total amount of oxidized and nonoxidized recovered paper fibers, based on the total fiber quantity).

The examples which follow illustrate the invention.

I. Input Materials

I.1 Sample Material: Fiber Materials

Recovered paper pulps from Hoya (a mixture of the recovered paper grades 1.02/1.04/4.01) and Sappemeer (fibers from paper grades 0012 to 0015) were used.

I.2 Chemicals: TEMPO

TEMPO solid material (CAS number: 2564-83-2, catalogue No. A12733) was obtained as a free radical having a purity of 98% from Alfa Aesar GmbH, Karlsruhe, Germany.

I.3 Enzymes

The laccases used for oxidation are reported in table 1 together with their source and their respective activities.

TABLE 1

| Laccase/organism | Source | Activity/mg of protein |
|---|---|---|
| *Trametes versicolor* | Fluka | 250 U |
| Laccase A - *Agaricus bisporus* | ASA Spezialenzyme GmbH | 12.8 U |
| Laccase AB - *Agaricus bisporus* | Jülich Fine Chemicals | 10.7 U |

TABLE 1-continued

| Laccase/organism | Source | Activity/mg of protein |
|---|---|---|
| Laccase C - *Trametes* spec. | ASA Spezialenzyme GmbH | 162.9 U |
| Laccase CX - *Trametes* spec. | Jülich Fine Chemicals | 12840 U/ml (suspension) |
| Laccase T - *Trametes* spec. | Jülich Fine Chemicals | 319.2 U |
| Laccase 51003 - *Aspergillus* spec. | Novozymes | 47760 U |
| Laccase RV - *Rhus vernificera* | Sigma | 120 U |

Laccase activity was determined as described above by oxidizing the substrate syringaldazine to the corresponding quinone.

II. Oxidation of Recovered Paper Pulp

A pulper from Escher & Wyss was used. The maximum capacity of the apparatus is 15 liters. Alternatively pulpers from Voith can be used.

The pulper is charged with 500 g of recovered paper pulp and 12.5 liters of water to produce a 4% suspension, which is beaten for 15 minutes. The recovered paper pulp suspension thus obtained was transferred to a 15 liter bucket, which optionally has chicanes, for oxidation. The following components were added to the bucket: 5.4 liters of the beaten recovered paper pulp (216 g of pulp dry weight), 0.6 liters of 1M potassium dihydrogenphosphate buffer, pH 6, the desired amount of *T. versicolor* laccase and TEMPO. Each batch was left to stand at room temperature overnight, i.e., for 14 to 16 h. The amounts of laccase and TEMPO and the reaction time can be varied to achieve certain degrees of oxidation and/or certain CHO to COOH ratios. Experiments 1 and 2 were carried out in 15 L buckets without chicanes. The results of the oxidation are presented in table 2.

TABLE 2

| Exp. | kU/kg pulp | g TEMPO/kg pulp | COOH [mmol/kg] | CHO [mmol/kg] |
|---|---|---|---|---|
| 1 | 400 | 10 | 10 | 18.5 |
| 2 | 400 | 50 | 25.5 | 23.5 |

The data for COOH and CHO in table 2 relate to the CHO and COOH groups additionally generated by oxidation.

III. Production of Test Sheets

Test sheets were produced in a Rapid Köthen sheet-former. The following tests were carried out: dry breaking length, wet breaking length, (tongue) tearing strength (DIN 53115) and water retention value (WRV) SCAN-C 62:00. The results are shown in table 3.

TABLE 3

| | | Dry breaking length [m] | | | Wet breaking length [m] | | | Tearing Strength [mNm/m] | | |
|---|---|---|---|---|---|---|---|---|---|---|
| Exp. | WRV [%] | Ref. | Ox. | Rel [%] | Ref. | Ox. | Rel [%] | Ref. | Ox. | Rel [%] |
| 1 | 118 | 2235 | 2357 | 105.5 | 104 | 176 | 169.2 | 708 | 924 | 130.5 |
| 2 | 126 | 2235 | 2712 | 121.3 | 104 | 235 | 226 | 708 | 988 | 139.5 |

Ref.: reference value,
Ox.: oxidized sample,
Rel.: relative to background,
V: comparative example.

Tables 2 and 3 show by way of example the results obtained with Sappemeer recovered paper. Experiment 1 was carried out in buckets without chicanes by stirring with 400 kU of laccase and 10 g of TEMPO per kg of recovered paper pulp. The oxidation raised the COOH content by 0.2% and the CHO content by 0.37%. Dry breaking length was 105% relative to background, wet breaking length 169% and (tongue) tear energy 130%. The oxidation in experiment 2 with 400 kU of laccase and 50 g of TEMPO per kg of recovered paper pulp in buckets without chicanes resulted in increases by 0.51% of COOH and 0.47% of CHO. Dry breaking length and (tongue) tear energy at 121% and 139% were better than in experiment 1, the increase in wet breaking length is still acceptable.

IV. Determination of Drainage and Retention Properties:

In the experiments hereinbelow, the properties of inventive pulp compositions are compared with noninventive pulp compositions in which the oxidized recovered paper pulp in the inventive compositions was replaced by conventional recovered paper pulp. The comparisons were conducted for first pass retention and ash retention using the Tappi T-261 Britt Jar Test Method. In addition, drainage time DT was determined (according to ISO Standard 5276).

The oxidized pulp used for these experiments was produced by oxidizing conventional recovered paper pulp (Hoya) as per the prescription for experiment 1 by varying the amounts of laccase (*Trametes versicolor,* 250 U) and TEMPO in the way reported in table 4:

TABLE 4

| Experiment | Laccase [% by weight][1)] | TEMPO [% by weight][1)] | COOH [mmol/kg] | CHO [mmol/kg] |
|---|---|---|---|---|
| 3 | 2.0 | 0.00 | 96 | 28.7 |
| 4 | 2.0 | 0.05 | 100-200* | 28.9 |
| 5 | 2.0 | 0.20 | 100-200* | 34.9 |
| 6 | 2.0 | 0.40 | 100-200* | 54.8 |

[1)]based on 1 kg of recovered paper pulp

*estimated from measured data because of measurement inaccuracy

Inventive examples 1 to 4, comparative examples 1 to 3

In the examples which follow, a mixture of groundwood GW, pinewood sulfate pulp SP and recovered paper pulp DIP or oxidized recovered paper pulp DIP(E) of experiments 3 to 6 (DIP(E3) to DIP(E6)) together with precipitated calcium carbonate (PCC) in water was diluted to a consistency of 0.5% and stirred in the test apparatus at 1000 rpm. To this was added the fixing aid (Catiofast SF polyethyleneimine, from BASF SE) followed after 60 seconds by the metered addition of the retention aid (Polymin PR 8247 polyvinylamine, from BASF SE). After 20 seconds, a white water sample was taken to determine first pass retention and ash retention.

Drainage time DT was measured according to ISO Standard 5276 using a Schopper-Riegler tester wherein 1 liter of an aqueous slurry of the fiber composition to be tested, having a consistency of 10 g/l, was drained while taking the time in seconds needed for 400 ml of the filtrate to pass through.

Input materials and use levels and also the results are collated in table 5:

TABLE 5

| | Example | | | | | | |
|---|---|---|---|---|---|---|---|
| | V1 | V2 | V3 | 1 | 2 | 3 | 4 |
| GW [% by weight][1)] | 50 | 50 | 50 | 50 | 50 | 50 | 50 |
| DIP [% by weight][1)] | 40 | 40 | 40 | 40(E3) | 40(E4) | 40(E5) | 40(E6) |
| SP [% by weight][1)] | 10 | 10 | 10 | 10 | 10 | 10 | 10 |
| PCC [% by weight][1)] | 50 | 50 | 50 | 50 | 50 | 50 | 50 |
| Laccase (% by weight @ ws)[2)] | | | | 2.0 | 2.0 | 2.0 | 2.0 |
| TEMPO (% by weight @ ws)[2)] | | | | 0.00 | 0.05 | 0.20 | 0.40 |
| Polymin (% by weight @ ws)[3)] | | 0.04 | 0.04 | 0.04 | 0.04 | 0.04 | 0.04 |
| Catiofast (% by weight @ ws)[3)] | | | 0.10 | 0.10 | 0.10 | 0.10 | 0.10 |
| DT 400 mL [sec] | 53 | 20 | 18 | 17 | 18 | 17 | 16 |
| Britt DJ - FPR [%] | 43.3 | 62.1 | 64.6 | 66.8 | 67.0 | 67.7 | 68.2 |
| Ash - FPAR [%] | 7.0 | 41.4 | 45.1 | 48.8 | 48.3 | 49.7 | 51.5 |

[1)] based on total fiber material
[2)] based on fiber material at oxidation
[3)] based on fiber suspension

We claim:

1. A process for producing a paper or a solid board, the process comprising:

i) suspending a)-c) in water to form a fiber suspension:

a) a chemical pulp A;

b) an oxidized pulp B in which, by oxidation of at least one conventional pulp selected from the group consisting of a recovered paper pulp, a mechanical pulp and mixtures thereof, from 1 to 500 mmol of carboxyl groups and from 1 to 200 mmol of aldehyde groups per kg of the conventional pulp have been introduced; and c) a further conventional pulp C other than the chemical pulp A and the oxidized pulp B;

ii) optionally adding a customary additive, filler, or both; and iii) draining a resulting aqueous fiber suspension in a paper machine to form a paper or a solid board, wherein:

a total amount of the chemical pulp A and the oxidized pulp B is from 30% to 80% by weight of an entire pulp mass in the fiber suspension;

a total amount of the chemical pulp A, the oxidized pulp B, and the further conventional pulp C is at least 70% of the entire pulp mass in the fiber suspension; and said amounts are measured as oven dry materials wherein a molar ratio in the oxidized pulp B of the carboxyl groups introduced to the aldehyde groups introduced is greater than 1:1; and a paper or a solid board produced exhibits greater dry strength properties without incurring a significant increase (to an extent which has no appreciable effect on later repulping) in wet strength properties, relative to a paper or solid board produced from a pulp composition which does not comprise the oxidized pulp B.

2. The process according to claim 1, wherein the oxidized pulp B and the further conventional pulp C account for from 70% to 98% by weight of the entire pulp mass in the fiber suspension, measured as oven dry materials.

3. The process according to claim 1, wherein the oxidized pulp B accounts for at least 50% by weight, based on a total amount of the oxidized pulp B and the chemical pulp A in the fiber suspension.

4. The process according to claim 1, wherein the oxidized pulp B is an oxidized recovered paper pulp.

5. The process according to claim 1, wherein the further conventional pulp C is selected from the group consisting of a conventional mechanical pulp, a thermomechanical pulp, and a conventional recovered paper pulp.

6. The process according to claim 1, which is suitable for producing a writing paper comprising:

10% to 99% by weight of recovered paper fibers (total amount of oxidized and non-oxidized recovered paper fibers), based on a total amount of fiber constituents; and 5% to 30% by weight of at least one filler, wherein a basis weight of the writing paper in the range from 30 to 80 g/m$^2$.

7. The process according to claim 1, which is suitable for producing a packaging paper.

8. The process according to claim 1, which is suitable for producing a solid board.

9. The process according to claim 1, which is suitable for producing a printing paper comprising:

10% to 99% by weight of recovered paper fibers (total amount of oxidized and non-oxidized recovered paper fibers, based on a total amount of fiber constituents; and up to 20% by weight of at least one filler, wherein a basis weight of the printing paper in the range from 40 to 150 g/m$^2$.

* * * * *